US005803640A

United States Patent [19]

Nakajima et al.

[11] Patent Number: 5,803,640

[45] Date of Patent: Sep. 8, 1998

[54] APPLICATOR

[75] Inventors: Nobuyuki Nakajima, Takasaki; Mitsuru Endou, Tano-gun; Takashi Umeno, Sawa-gun, all of Japan

[73] Assignee: Mitsubishi Pencil Kabushiki Kaisha, Tokyo, Japan

[21] Appl. No.: 792,842

[22] Filed: Feb. 3, 1997

[30] Foreign Application Priority Data

Jun. 4, 1996 [JP] Japan ..... 8-141893

[51] Int. Cl.[6] ..... A46B 11/02

[52] U.S. Cl. ..... 401/174; 401/202; 401/247; 401/288

[58] Field of Search ..... 401/174, 288, 401/202, 247

[56] References Cited

U.S. PATENT DOCUMENTS 4,950,241 8/1990 Ranford ..... 604/110

FOREIGN PATENT DOCUMENTS 6-79420 11/1990 Japan .
5207912 8/1993 Japan ..... 401/288
6-1266 1/1994 Japan .
6-1267 1/1994 Japan .
6-20418 1/1994 Japan .
6-22816 1/1994 Japan .
6-13715 2/1994 Japan .
2229791 3/1990 United Kingdom ..... 401/174

*Primary Examiner*—Steven A. Bratlie
*Attorney, Agent, or Firm*—Darby & Darby

[57] ABSTRACT

An applicator includes: a barrel cylinder; an application portion in front of the barrel cylinder; a tank placed behind the application portion for storing liquid inside the barrel cylinder; a pipe (conduit) for conducting the liquid ejected from the tank to the application portion; a piston which is fitted in the tank as to slide in the axial direction ensuring a watertight contact; and a liquid pushing device placed in the rear part of the barrel cylinder for pushing the liquid from the tank to the application portion via the pipe by moving the piston forwards. In this applicator, the bore of the pipe is set between 0.2 mm and 1.7 mm, and the viscosity of the liquid measured by the E-type viscometer within an temperature range for operation is set between 20 mpa.sec and 100,000 mpa.sec. Further, the barrel cylinder is formed of PP, and the piston is formed of HDPE or LLDPE.

5 Claims, 15 Drawing Sheets

APPLICATOR

BACKGROUND OF THE INVENTION (1) Field of the Invention

The present invention relates to a cosmetic container from which a liquid makeup cosmetic such as lip coloring, concealer, foundation, shadow coloring, etc., is ejected through an application tip, as well as relating to an applicator which has this container and holds a typical ink therein so as to be used as a writing implement such as maker etc. and an applicator for colors etc.

(2) Description of the Prior Art

Conventionally, some applicators have been proposed which include a liquid reservoir, an application portion such as a brush, sponge etc., attached as an application tip for holding a liquid and an operating handle attached at the rear end of the barrel cylinder, and store a liquid in the liquid reservoir and supply the liquid to the application portion by rotating an operating handle so as to advance a piston in one direction to squeeze the liquid forwards to the application portion (see Japanese Utility Model Publication Hei 6 No.1, 266, Japanese Utility Model Publication Hei 6 No.1,267 and Japanese Utility Model Publication Hei 6 No.20,418). In this case, the application portion can be made up of that disclosed in for example Japanese Utility Model Application Laid-Open Hei 6 No.79,420, Japanese Utility Model Application Laid-Open Hei 6 No.13,715, or Japanese Patent Application Laid-Open Hei 6 No.22,816, etc. These application portions have an external portion having continuous-cell foams such as urethane foam, etc., and are improved by providing an extra oozing hole, by forming the external portion with two or more kinds of materials, or by providing an ejection opening of liquid on one side thereof.

Since in the above applicator, the liquid inside the liquid reservoir tank and the application portion such as a brush etc., communicated with one another through a communication hole, the liquid, in some cases depending upon the viscosity of the liquid and the size of the communication hole, tended to flow out when the application tip was oriented downward or when some vibration was imparted. Thus, the applicator suffered from the problems in that the liquid oozed into the application portion via the communication hole and smeared the application portion before use, or the liquid flowed out into the cap during storage.

The piston, which pushes the liquid out from the liquid reservoir tank, was conventionally made from a material with flexibility such as rubber, EVA, LDPE (low density polyethylene), etc., in view of the sealing performance with the bore of the barrel cylinder. Since the solvent component of the liquid was liable to permeate the material of the piston itself, readily change into vapor, the liquid inside the tank decreased when the applicator had been left in a place at a high temperature for a long period of time.

In contrast, when PP (polypropylene) which is less permeable, was used for the piston and also for the barrel cylinder, the barrel cylinder and piston were made from PP, the same material. In this case, when the piston advanced whilst sliding along the bore of the barrel cylinder in association with the advance of the threaded shaft, the sealing portion of the piston was caught by the interior wall of the barrel cylinder and had large sliding friction because of the same material and the same hardness, so that the force required for the delivery became large and thus the operativity was poor.

Further, since the sealing portion of the piston and the sliding surface of the barrel cylinder were made from the same material, the friction was liable to scar both the barrel cylinder and the piston and therefore it was very difficult to keep an absolutely sealed condition.

SUMMARY OF THE INVENTION

The present invention has been devised to solve the above problems, and it is therefore an object of the present invention to provide an applicator wherein the liquid is definitely prevented from flowing out to the application portion before use and wherein the piston is not permeable by the solvent and is able to smoothly advance inside the barrel cylinder under gentle force.

In order to solve the above problems, the invention is configured as follows:

In accordance with the first aspect of the invention, an applicator comprises: a barrel cylinder; an application portion in front of the barrel cylinder; a tank disposed behind the application portion for storing liquid inside the barrel cylinder; a conduit for conducting the liquid ejected from the tank to the application portion; a piston which is fitted in the tank as to slide in the axial direction; and a liquid pushing means disposed in the rear part of the barrel cylinder for pushing the liquid from the tank to the application portion via the conduit by moving the piston forwards, and is characterized in that the bore of the conduit for conducting the liquid to the application portion is set between 0.2 mm and 1.7 mm, and the viscosity of the liquid measured by the E-type viscometer within a temperature range for operation is set between 20 mPa.sec and 100,000 mPa.sec.

In accordance with the second aspect of the invention, an applicator comprises: a barrel cylinder; an application portion in front of the barrel cylinder; a tank disposed behind the application portion for storing liquid inside the barrel cylinder; a conduit for conducting the liquid ejected from the tank to the application portion; a piston which is fitted in the tank as to slide in the axial direction; and a liquid pushing means disposed in the rear part of the barrel cylinder for pushing the liquid from the tank to the application portion via the conduit by moving the piston forwards, and is characterized in that the barrel cylinder is made from PP (polypropylene) and the piston is made from HDPE (high density polyethylene) or LLDPE (linear low density polyethylene).

In accordance with the third aspect of the invention, an applicator having the above first or second feature, and is characterized in that the liquid pushing means comprises: a threaded shaft integrally adjoined to the rear part of the piston and having a flat portion formed on the side thereof; a threaded block which is mated with the threaded shaft and secured to the barrel cylinder so as neither to rotate nor move in the axial direction; a handle disposed on the rear side of the barrel cylinder; a delivering portion which has a flange having a cam surface on the rear side thereof, has an interior hollow having a rotation transmitting bore and is linked with the handle so as to integrally rotate with the handle and freely slide in the axial direction, the rotation transmitting bore having almost the same cross-section with the cross section of the threaded shaft in a transverse plane, at a site where the flat portion is formed and having the threaded shaft inserted therein; a spring support having a cam surface at the front end thereof; and a coil spring which presses the delivering portion and the spring support forwards to abut the delivering portion against the threaded block and fix the delivering portion in the axial direction, the rear end of the coil spring being abutted against the front end of the handle, and the threaded block, threaded shaft and/or delivering portion are formed of at least one of ABS, PBT and polycarbonate.

In accordance with the fourth aspect of the invention, an applicator comprises: a barrel cylinder; an application portion in front of the barrel cylinder; a tank disposed behind the application portion for storing liquid inside the barrel cylinder; a conduit for conducting the liquid ejected from the tank to the application portion; a piston which is fitted in the tank as to slide in the axial direction; and a liquid pushing means disposed in the rear part of the barrel cylinder for pushing the liquid from the tank to the application portion via the conduit by moving the piston forwards, and is characterized in that the bore of the conduit for conducting the liquid to the application portion is set between 0.2 mm and 1.7 mm, and the viscosity of the liquid measured by the E-type viscometer within a temperature range for operation is set between 20 mPa.sec and 100,000 mPa.sec, the barrel cylinder is made from PP (polypropylene) and the piston is made from HDPE (high density polyethylene) or LLDPE (linear low density polyethylene), the liquid pushing means comprises: a threaded shaft integrally adjoined to the rear part of the piston and having a flat portion formed on the side thereof; a threaded block which is mated with the threaded shaft and secured to the barrel cylinder so as neither to rotate nor move in the axial direction; a handle disposed on the rear side of the barrel cylinder; a delivering portion which has a flange having a cam surface on the rear side thereof, has an interior hollow having a rotation transmitting bore and is linked with the handle so as to integrally rotate with the handle and freely slide in the axial direction, the rotation transmitting bore having almost the same cross-section with the cross section of the threaded shaft in a transverse plane, at a site where the flat portion is formed and having the threaded shaft inserted therein; a spring support having a cam surface at the front end thereof; and a coil spring which presses the delivering portion and the spring support forwards to abut the delivering portion against the threaded block and fix the delivering portion in the axial direction, the rear end of the coil spring being abutted against the front end of the handle, and the threaded block, threaded shaft and/or delivering portion are formed of at least one of ABS, PBT and polycarbonate.

The present invention is described with reference to FIG. 1.

As shown in FIG. 1, a barrel cylinder 1 has a front-end opening 2 to which a joint 3 is attached. A pipe (corresponding to conduit) 4 is squeezed into the front side bore (designated at 3*i*) of joint 3. The purpose of pipe 4 is to conduct the liquid inside barrel cylinder 1 (tank 6) to the front end of pipe 4 by way of a pipe hollow 4*i* inside pipe 4. The front end of pipe 4 is enclosed in an application portion 5 such as a brush, etc., so that the liquid can be conducted to the required position for application portion 5 and will be supplied to the application portion 5.

The outside diameter of pipe 4 is limited by the size of application portion 5, but can be freely designated within the limit.

The viscosity of the liquid filled in liquid tank 6 inside barrel cylinder 1 is set up in consideration of the use performance and other factors.

In a liquid pushing device 12 in FIG. 1, an operating handle 20 attached to the rear end of barrel cylinder 1 is rotated relative to barrel cylinder 1. A delivering portion 16 is constrained in a rotational direction relative to operating handle 20, but freely slides in the forward direction of operating handle 20.

A threaded shaft 14 is constrained in a rotary direction relative to delivering portion 16 but freely slides forwards. Threaded shaft 14 is mated to a threaded socket 15 which is fixed to barrel cylinder. A piston 11 is attached to the front end of threaded shaft 14.

In the applicator thus configurated above, which has a liquid pushing means having a piston sliding in contact with the interior wall of the barrel cylinder tank, the pipe bore is set between 0.2 mm and 1.7 mm, and the viscosity of the liquid measured by the E-type viscometer is set between 20 mPa.sec and 100,000 mpa.sec. In this setup condition, even if the liquid reservoir tank and the application portion communicate with one another via a commutation hole, the liquid in the liquid reservoir tank will not flow out to the application portion via the communication hole when the applicator is vibrated during transportation or when the application is kept in stock with its tip down, etc. Accordingly, the liquid will never smear the application portion before use. Further, the liquid will not ooze out to the application portion during use, thus it is possible to provide an applicator which prevents the liquid from dripping from the application portion to smear the interior of the cap.

If the pipe bore is greater than 1.7 mm, the liquid is liable to ooze out to the application portion causing leakage due to impacts and vibrations during use or transportation.

In the case where the pipe bore is smaller than 0.2 mm, the pipe bore is too small to establish smooth flow. Specifically, when the liquid is attempted to be ejected out by rotating the operating handle to advance the piston, the liquid does not flow smoothly because the flow resistance of the liquid against the pipe is too great, thus causing delay of ejection.

Here, the delay of ejection means a phenomenon in that the amount of liquid per unit time ejected from the pipe, decreases because the bore of the pipe communication hole is small and therefore the flow resistance of the liquid becomes large when the liquid is pressurized by the advance of the piston, so that even the maximally pressurized liquid needs time to flow out from the pipe. Since the liquid will not come out right after the user rotates the operating handle, the user tends to rotate the operating handle more than needed. As a result, a larger amount of liquid than needed comes out in a delayed manner, resulting in messy use.

Table 1 shows a relation between the viscosity of liquid and the pipe bore.

Leakage of liquid when the applicators were inverted and vibrated is shown in Table 2.

TABLE 1

Delay of ejection

| | | Pipe bore (mm) | | | | | |
|---|---|---|---|---|---|---|---|
| | | 2.0 | 1.7 | 1.0 | 0.5 | 0.2 | 0.1 |
| Liquid viscosity (mPa · sec.) | 1 million | A | B | B | C | C | D |
| | 100,000 | A | A | A | B | B | D |
| | 10,000 | A | A | A | A | B | D |
| | 1,000 | A | A | A | A | B | D |
| | 20 | A | A | A | A | B | D |
| | 10 | A | A | A | A | B | C |

A: no delay of ejection
B: intermediate level between A and C
C: Ejection somewhat delayed
D: Ejection delayed

TABLE 2

Leakage of liquid when the applicators were inverted and vibrated

| | | Pipe bore (mm) | | | | | |
|---|---|---|---|---|---|---|---|
| | | 2.0 | 1.7 | 1.0 | 0.5 | 0.2 | 0.1 |
| Liquid viscosity (mPa · sec.) | 1 million | A | A | A | A | A | A |
| | 100,000 | A | A | A | A | A | A |
| | 10,000 | B | A | A | A | A | A |
| | 1,000 | B | A | A | A | A | A |
| | 20 | B | A | A | A | A | A |
| | 10 | B | B | A | A | A | A |

A: No leakage of liquid
B: Liquid leaked

The barrel cylinder is formed of PP (polypropylene), in place of PE (polyethylene) in order to make the solvent from the barrel cylinder permeate less whilst satisfying the demand of the barrel strength during use.

It is also possible to lessen the ability of the solvent to permeate by using PP (polypropylene) for the piston. In this case, however, the barrel cylinder and the piston are of a like material, therefore, the two parts have the same surface hardness, so that the bore of the barrel cylinder and the sealing surface of the piston become liable to be scarred by the sliding action of the piston pushing the liquid out. As a result, the sealing portion of the piston becomes liable to bite or be caught by, the inner surface of the barrel cylinder, thus needing a greater force for moving the piston. Further, the sealing surfaces of the barrel cylinder of PP and piston of PP are scarred so that the sealed interface between the barrel cylinder and the piston is prone to become defective.

To solve the problem, in this invention, the piston is made from LLDPE (linear low density polyethylene: middle-hardness polyethylene) which is less permeable than LDPE (low density polyethylene: soft polyethylene) and has a more slidability with PP than PP. Also, the piston may be made from HDPE (high density polyethylene:hard polyethylene) which is higher in density and further less permeable.

When the threaded socket, threaded shaft and delivering portion were formed with resin which is not very strong such as PP, PE, etc., it was impossible to obtain a strong enough force for delivery during use because of its deformation and weakness in strength of the threads.

Particularly, from the requirement of the mechanical design for the threaded shaft and threaded socket of the products related to this invention, the outside diameter of the thread was set small (at 4.2 mm or less), the thread was formed with a short pitch (of 1.0 or less) and the threaded shaft was formed with a flat surface portion. Therefore, the engagement between the thread part on the outside of the threaded shaft and the thread part on the inner surface of the threaded socket bore was not completely ensured. In such a product, when a high-viscosity liquid was used or when a high-viscosity liquid as used in this invention was ejected via a relatively thin pipe after the applicator had been left with its cap off, a stress was generated between the threaded socket and threaded shaft when the operating handle was rotated to advance the piston because the liquid was hard to push out. Since the threads of the conventional product were made from PP, PE or the like, which have a low yield strength, and had low thread-meshing heights and were partially engaged with one another not across the entire part, the threads were liable to skid and therefore the liquid could not be pushed out smoothly.

Therefore, a resin having a high yield strength such as ABS, PBT and polycarbonate is used as to solve the above problem.

In view of the stability of the molding dimension and yield strength, polycarbonate is the most preferable, especially when the thread-height for mesh is low (specifically, 3.8 mm or less for the outside diameter of the thread shaft with a pitch of 0.5 or less).

DESCRIPTION OF THE PREFERRED EMBODIMENTS

The embodiments of the present invention will hereinafter be described in detail with reference to the accompanying drawings.

First, an applicator in accordance with the first embodiment will be described.

Figure 1:
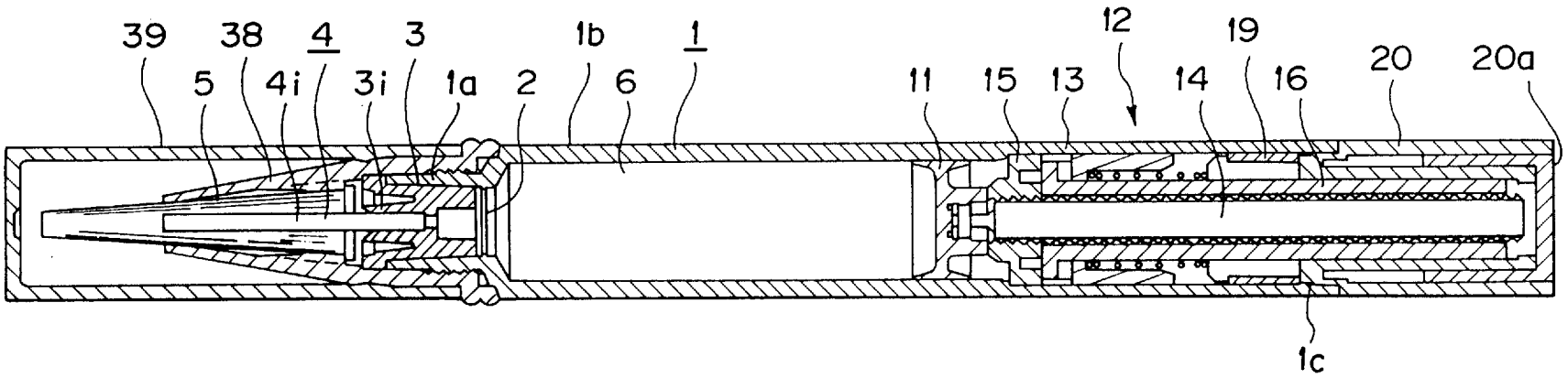
FIG. 1 is an overall sectional view for illustrating an applicator of the first embodiment.
Figure 2:
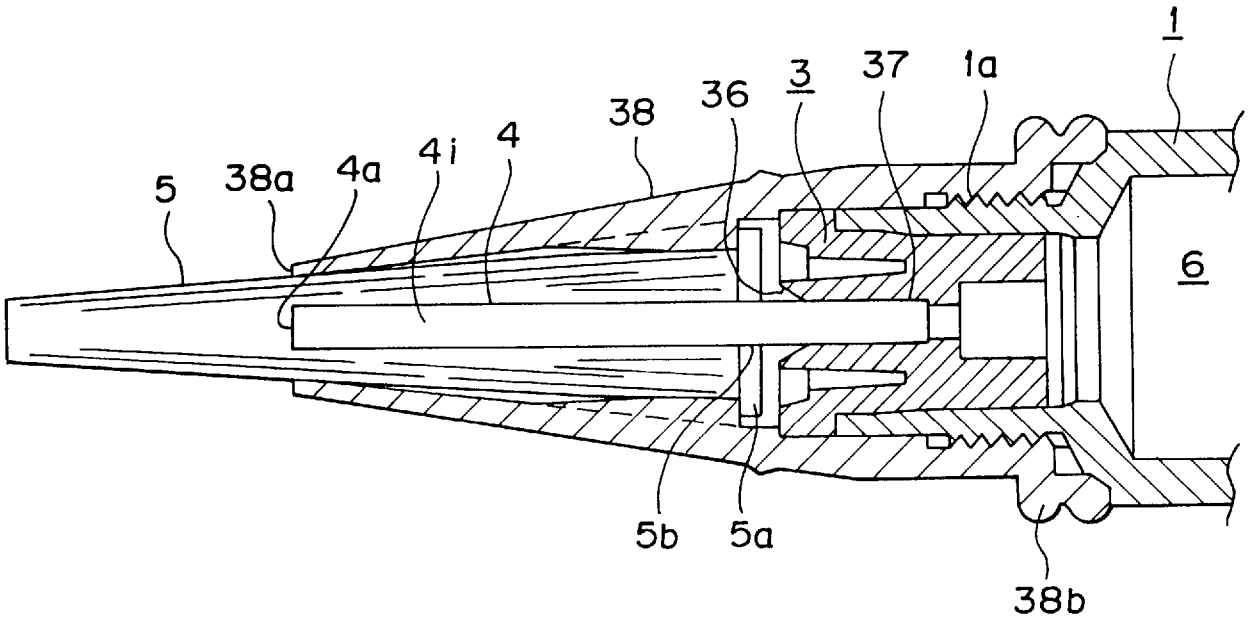
FIG. 2 is a detailed sectional view showing the front-end part of an applicator of the first embodiment.
Figure 3:
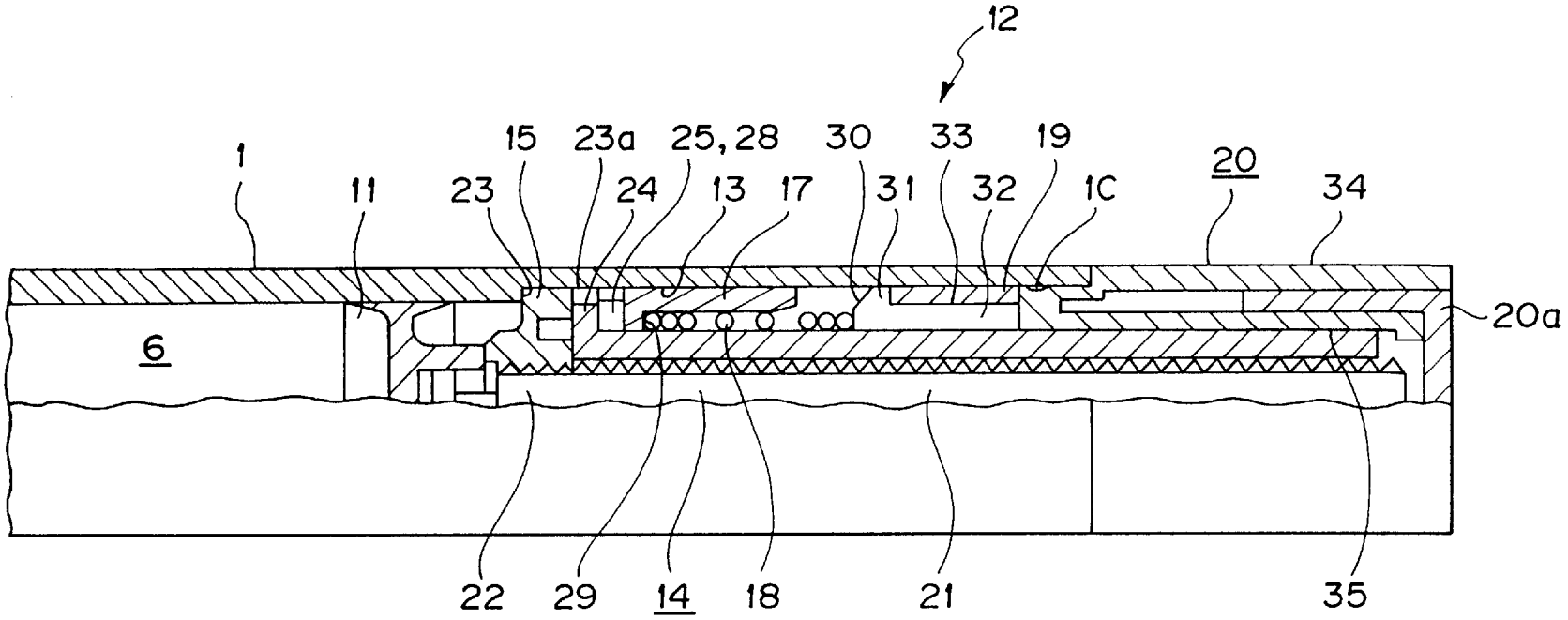
FIG. 3 is a detailed half sectional view showing a liquid pushing device of an applicator of the first embodiment.
Figure 4:
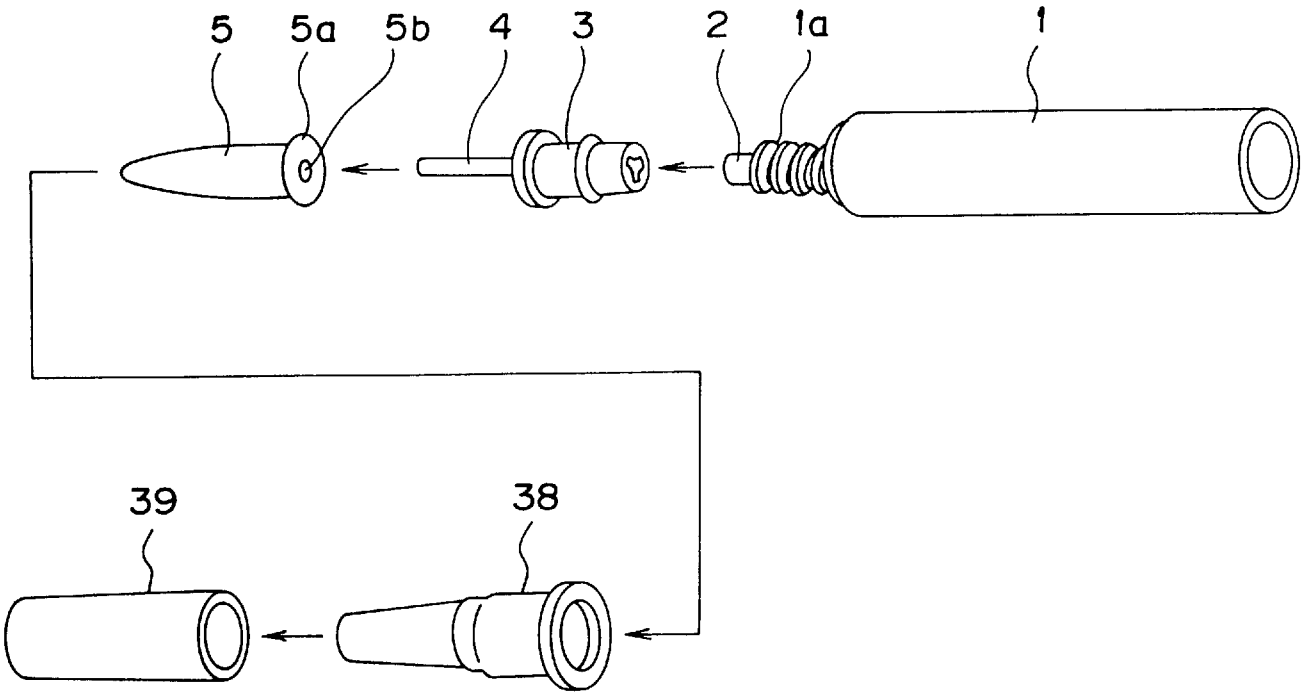
FIG. 4 is an exploded view showing the barrel cylinder and the front-end part of an applicator of the first embodiment.
Figure 5:
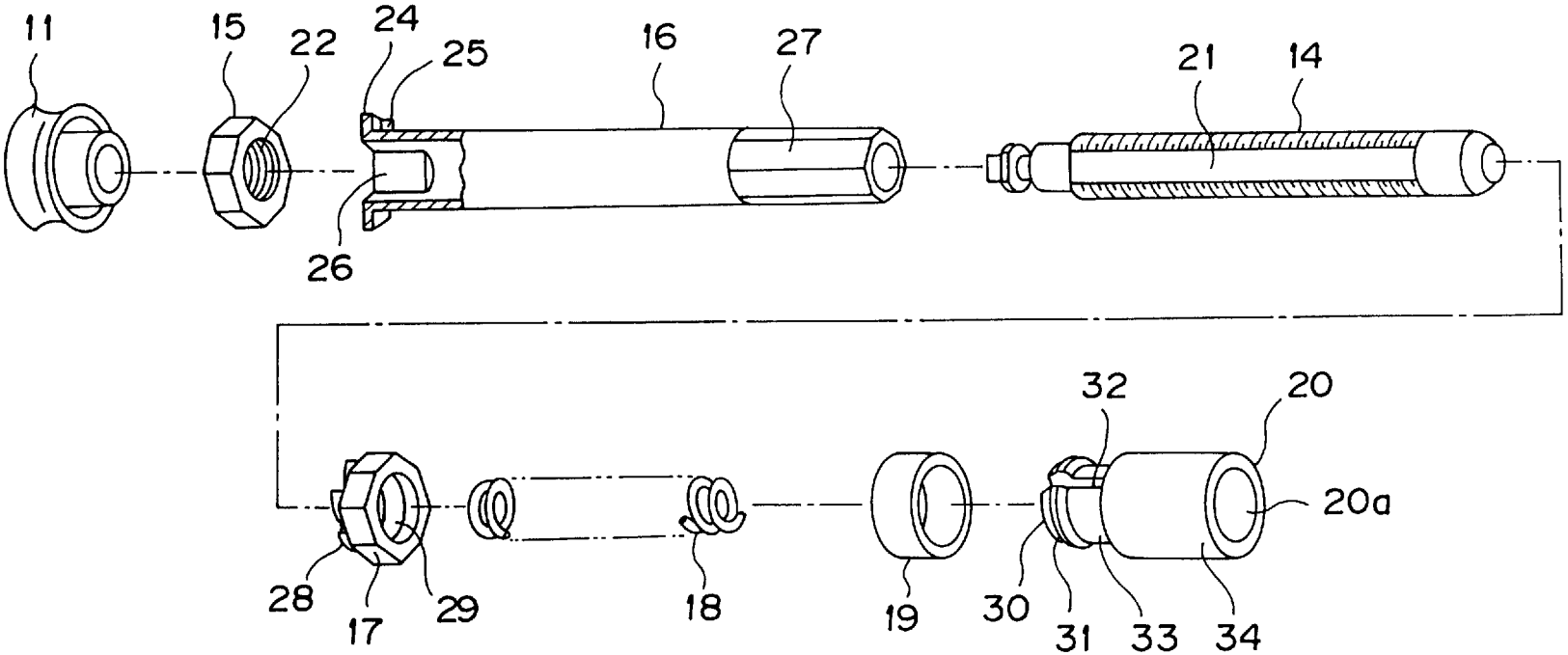
FIG. 5 is an exploded illustrative view showing a liquid pushing device of an applicator of the first embodiment.
Figure 6:
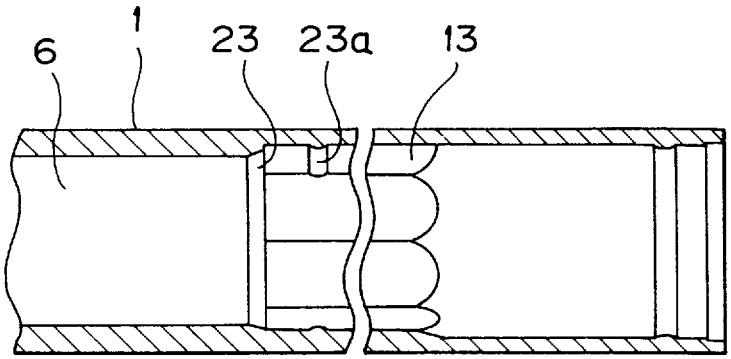
FIG. 6 is an illustrative view showing the interior of the central part of the cylinder barrel of an applicator of the first embodiment.
Figure 7:
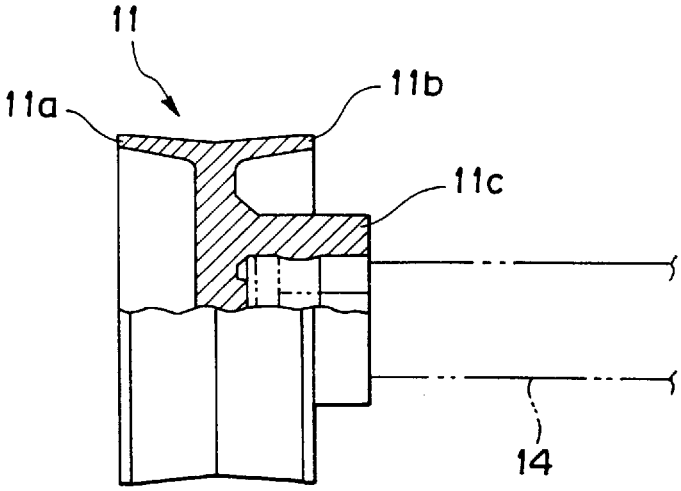
FIG. 7 is a half sectional view showing a piston of an applicator of the first embodiment.
Figure 8:
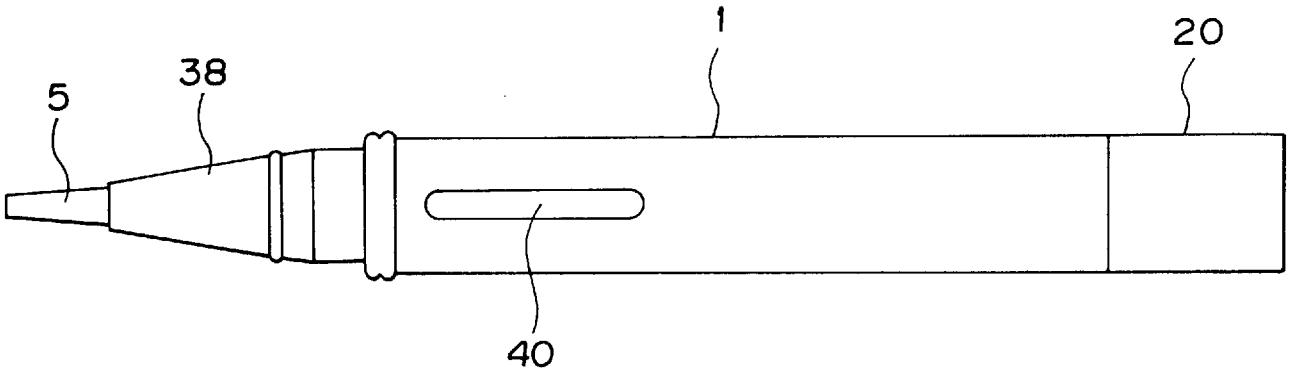
FIG. 8 is an illustrative view showing a variation of an applicator of the first embodiment.

FIGS. 1 through 8 are illustrative views showing the applicator of this embodiment. FIG. 1 is an overall sectional view; FIG. 2 is a detailed sectional view of the front-end part; FIG. 3 is detailed half sectional view of a liquid pushing device; FIG. 4 is an exploded view of the barrel cylinder and the front-end part; FIG. 5 is an exploded illustrative view of the liquid pushing device; FIG. 6 is an illustrative view showing the interior of the central part of the barrel cylinder; FIG. 7 is a half sectional view showing a piston; and FIG. 8 is an illustrative view showing a variation.

As shown in FIG. 1, the applicator of the first embodiment includes: a barrel cylinder 1; an application portion 5 in front of barrel cylinder 1; a tank 6 disposed behind application portion 5 for storing liquid inside barrel cylinder 1; a pipe (conduit) 4 for conducting the liquid ejected from tank 6 to application portion 5; a piston 11 which is fitted in tank 6 as to slide in the axial direction ensuring a watertight contact; and a liquid pushing device 12 disposed in the rear part of barrel cylinder 1 for pushing the liquid from tank 6 to application portion 5 via pipe 4 by moving piston 11 forwards.

The bore of pipe 4 is set between 0.2 mm and 1.7 mm, and the viscosity of the liquid measured by the E-type viscometer is set between 20 mPa.sec and 100,000 mPa.sec. In this setup condition, even if liquid reservoir tank 6 and application portion 5 communicate with one another via a commutation hole 4*i* inside pipe 4, the liquid in liquid reservoir tank 6 will not ooze out to application portion 5 via communication hole 4*i* when the applicator is vibrated during transportation or when the application is kept in stock with its tip down, etc. Accordingly, the liquid will never smear application portion 5 before use. Since the liquid will not ooze out to application portion 5 during use, thus preventing the liquid from dripping from application portion 5 to smear the interior of the cap (designated at 39).

In detail, the applicator comprises: barrel cylinder 1 which has a small-diametric portion 1*a* with an opening 2 at the front end thereof and a large-diametric portion 1*b* whose front half forms tank 6 for storing liquid such as a cosmetic liquid or ink etc. and whose rear half has an internally polygonal-walled portion 13 formed behind tank 6; and piston 11 which is fitted in tank 6 as to slide in the axial direction ensuring a watertight contact.

Pushing device 12 for moving piston 11 of the applicator forwards is mainly composed, as detailedly shown in FIG. 3, of a threaded shaft 14, a threaded socket 15, a delivering portion 16, a spring support 17, a coil spring 18, an anti-fall stopper 19 and a rotary handle 20.

Threaded shaft 14 is integrally adjoined to the rear part of piston 11 and has a pair of flat portions 21 which are formed on the opposite sides and extend near the retracted position.

Threaded socket 15 has a thread part 22 formed on the central bore surface thereof and the peripheral side of it is defined by a plurality of facets forming a polygonal prism so that this socket is fitted into internally polygonal-walled portion 13 (see FIG. 6) of barrel cylinder 1. Therefore, the front end of the socket is prohibited from rotating relative to barrel cylinder 1 and is fixed to abut a stepped portion 23 formed on the inner surface of the barrel cylinder while the rear end is sealed by projection 23*a* formed on the interior surface of the barrel cylinder so that the socket can not move in the axial direction either. The aforementioned threaded shaft 14 is mated to thread part 22 and screwed into the central hole of the socket.

Delivering portion 16 is generally of a cylindrical shape and has a flange 24 on the outside peripheral portion at the front end. The delivering portion further has a ratchet portion 25 on the rear face of flange 24 and a rotation transmitting bore 26 formed in the front end of the internal portion thereof. This bore 26 has a transverse cross section having almost the same shape as, but slightly greater than, the cross section of threaded shaft 14 in a transverse plane, at a site where flat portions 21 are formed. Further, the rear end part of the delivering portion 16 is formed with an externally polygonal-walled portion 27. Then, threaded shaft 14 is inserted to the interior of delivering portion 16 from the rear end so that it can rotate together with delivering portion 16 by its engagement with rotation transmitting bore 26.

The peripheral side of spring support 17 is defined by a plurality of facets forming a polygonal prism. Spring support 17 has a ratchet portion 28 on the front face thereof. Provided on the rear face is a concave receiving seat 29. Spring support 17 is fitted so as not to rotate, into internally polygonal-walled portion 13 of barrel cylinder 1 and is fitted on the outside of delivering portion 16 so that ratchet portion 28 is meshed with ratchet portion 25 of flange 24 of delivering portion 16.

Coil spring 18 is fitted on the outside of delivering portion 16 so that its front end presses spring support 17 forwards whereby the front face of flange 24 of delivering portion 16 is always abutted on the rear face of threaded socket 15. Thus, delivering portion 16 is fixed adequately with respect to the axial direction.

Anti-fall stopper 19 is fitted into the interior surface at the rear end of barrel cylinder 1.

Rotary handle 20 comprises a small-diametric pipe portion 33 at the front part thereof and a large-diametric pipe portion 34 in the rear part thereof. Small-diametric pipe portion 33 has a receiving seat 30 and an engaging projection 31 at the front end thereof with a slit 32 which extends in the axial direction and permits elastic deformation in the radial direction. Large-diametric pipe portion 34 has the same outside diameter as the barrel cylinder 1 and the interior of it is formed with an internally polygonal-walled portion 35 into which the rear end of delivering portion 16 or externally polygonal-walled portion 27 is inserted. Thus, rotary handle 20 is linked with delivering portion 16 integrally in the rotational direction and can slide in the axial direction while small-diametric portion 33 is inserted into the rear opening of barrel cylinder 1 and snap fitted or resiliently attached until receiving seat 30 and engaging projection 31 are positioned in front of anti-fall stopper 19 so that receiving seat 30 supports the rear end of coil spring 18 and engaging projection 31 engages the front rim of anti-fall stopper 19. In this way, the handle is attached rotatably relative to barrel cylinder 1.

Further, rotary handle 20 can rotate relative to barrel cylinder 1 but will not be pulled out. The front end of rotary handle 20 has engaging projection 31 with slit 32 so that it can warp easily. Anti-fall stopper 19 of annular shape is forced to pass over engaging projection 31 and fit on the outside of small-diametric portion 33 of rotary handle 20, so that rotary handle 20 is able to slide freely relative to anti-fall stopper 19 in a rotational direction. Anti-fall stopper 19 is caught by a projection 1*c* on the inner surface of barrel cylinder 1 so that rotary handle 20 will not be removed.

Here, anti-fall stopper 19 may be made from either metal or resin.

As shown in FIG. 2, a joint 3 in the front-end part of the applicator has a depressed portion 36 on the front side. A communication hole 37 is penetrated from the center of depressed portion 36 to the rear-end surface of the joint. This joint 3 is squeezed from the front opening of barrel cylinder 1 and fixed in a watertight manner to the bore of front-end small-diametric portion la of barrel cylinder 1.

The rear end of pipe 4 is squeezed into the front half of communication hole 37 of joint 3 so that pipe 4 projects forwards from joint 3 by a predetermined length.

Application portion 5 is composed of a threadlike fibrous material. Pipe 4 is thrust into the back side of application portion 5 and the backside of application portion 5 is fitted into depressed portion 36 on the front side of joint 3 and fixed therein. In the figure, reference numeral 38 designates a mouthpiece (made from metal or plastic) which is screw fitted on front-end small-diametric portion 1*a* of the barrel cylinder so as to cover application portion 5 and joint 3 with the front end of application portion 5 projected. Designated at 39 is a cap which is detachable.

The embodiment will be described in further detail.

As shown in FIG. 5 or 7, piston 11 has a cylindrical hourglass shape, the shape whose diameter is center-narrowed and becomes greater as it goes forwards and rearwards. Since the diameter becomes greater as it goes forwards, when the piston is advanced to push the liquid out, the force which is acted on piston 11 moves the portion (front portion 11*a* at the front brim) of piston 11 which comes in contact with the interior surface of cylinder barrel 1, in the direction for creating further intimate contact so that the contact between piston 11 and barrel cylinder 1 can be improved. In this way, it is possible to completely push out all the liquid without leaving it in the interior of tank 6 of barrel cylinder 16.

Besides, the diameter of piston 11 becomes greater as it goes backwards and the outside diameter of the rear portion (designated at 11*b*) is practically equal to that of front portion 11*a*. Therefore, piston 11 will not come down inside barrel cylinder. Moreover, since the rear brim of rear portion 11*b* also has sealing performance, double-sealed structure created by the combination of front portion 11*a* and rear portion 11*b* can provide a further complete sealing performance. Since the piston does not come down relative to barrel cylinder 1, a further stable contact can be established. Since piston 11 has the cylindrical hourglass shape or the outside diameter at the center is smaller than the bore of tank 6 of barrel cylinder 1, the total area which comes in contact with barrel cylinder 1 when piston 11 advances is reduced and therefore the frictional resistance becomes small. Thus, it is possible to supply the liquid to application portion 5 by the stable rotational force from rotary handle 20. Formed in the center on the rear side of piston 11 is a cylindrical projected receiver 11*c,* into which the front end of threaded shaft 14 is inserted and fixed so as to rotate.

As shown in FIG. 2, for the fixture between joint 3 and pipe 4 in the front-end part of barrel cylinder 1, the hole (communication hole 37) of joint 3 into which pipe 4 is squeezed, is so formed that the diameter of the hole in the rear-side part of the hole is set smaller than the outside diameter of pipe 4 and greater than the bore of pipe 4. Accordingly, pipe 4 will not be displaced from the designated position rearwards or toward liquid tank 6 side even if pipe 4 is thrust from the front side.

The front end of pipe 4 is placed inside application portion 5, the brush of fibers put together. Front end 4*a* of pipe 4 is positioned inside mouth piece 38 or positioned on liquid reservoir tank 6 side with respect to front-end opening 38*a*. If application portion 5 with pipe 4 projected from mouthpiece 38 is pressed against an applied object, the object might be damaged since usually application portion 5 is made of a brush. Particularly, for applicators for a makeup cosmetic, there is a concern that the user might perceive a pressure sensation or scratching feeling on the skin. To prevent occurrence of such a situation, the embodiment is configured as above.

If only the joint 3 is used without pipe 4, the liquid is supplied to the rear part of the brush from communication hole 37 of joint 3. As a result, the liquid may enter the center hole of the brush, but also is supplied to the outside of the brush whereby the liquid tends to be pushed out as flowing over from the gap between the brush and mouthpiece 38, without reaching the tip of the brush.

In contrast to this, when pipe 4 is provided, the liquid is supplied near the brush tip so that the liquid moves along the brush fibers and flows out near the brush tip, thus providing comfortable use.

It is of course possible to integrally form pipe 4 and joint 3 as a machined part made from metal or as a molding article. In such cases, a metal-machined part is more expensive than the case where pipe 4 is formed of stainless steel, while the pipe portion for a molding article becomes thick so that it becomes difficult to produce a thin brush for an application portion, yet it can be used for an applicator with a thick brush.

Mouthpiece 38 is screw fitted to the front-end small-diametric portion 1*a* of barrel cylinder 1, and mouthpiece 38 has a projected portion 38*b* radially extending outwards at the rear brim thereof. Accordingly, when cap 39 is removed, the boundary between cap 39 and mouthpiece 38 can be clearly known enabling comfortable use.

Mouthpiece 38 and barrel cylinder 1 can be separated by a screw joint. In this case, as shown in FIG. 8, barrel cylinder 1 is formed of transparent resin and is coated with an unillustrated label, etc. with a partial window 40, by a method such as printing or image transfer so the only part of window 40 remains as a transparent portion. Accordingly, it is possible to check the color of liquid through this transparent window 40 from the outside. When transparent window 40 is positioned in the liquid end of liquid tank 6 of barrel cylinder 1, it is possible to visually check the position of piston 11 during use, thus facilitating the recognition of liquid end.

Here, as long as mouthpiece 38 and barrel cylinder 1 are formed separately, the same effect can be obtained even though they are fixed by press-fitting.

In the case where mouthpiece 38 is screw fitted to barrel cylinder 1, a stronger connection can be ensured than in the case of press-fitting.

As for a configuration in which the mouthpiece and barrel cylinder 1 is formed integrally, if window 40 is provided for barrel cylinder 1 so that the liquid can be seen, barrel cylinder should be molded from transparent resin. In this case, it is impossible to coat the mouthpiece portion by transfer or printing, therefore the appearance of this portion becomes awkward because the interior parts such as brush, etc., are also seen.

One example of application portion 5 is constructed so that fibers are bundled circularity and its rear-end portion 5*a* is heated so as to fuse the fibers and join them. The fused rear-end portion 5*a* has a brim-like structure having a greater outside diameter than that of the fiber bundle, as shown in FIG. 2. The brim-like portion 5*a* which is fused, is formed at the center thereof with a hole 5*b* into which pipe 4 inserted. The shape of mouthpiece 38 has a circular cross section in the position where the brush (5) is fixed or into which the brim (5*a*) is fitted, while the cross section of the mouthpiece in the plane of opening 38*a* at the front end of mouthpiece from which the brush comes out is made elliptic. This configuration makes the tip of the brush flat, thus resulting in convenient use for applying lip color etc. By replacing the cross-sectional shape of front-end opening 38*a* of mouthpiece 38, it is possible to readily produce different brush shapes for a specified use, such as round brush, flat brush, brush of a triangular pyramid, etc. using a common brush without changing the brush itself.

Ratchet portion 28 of spring support 17 and ratchet portion 25 of delivering portion 16 which are formed of cam surfaces having sawteeth, are pressed against each other by the force of coil spring 18. With a rotation of rotary handle 20, delivering portion 16 is rotated. However, spring support 17 is constrained in a rotational direction by barrel cylinder 1 so that spring support 17 can slide rearwards only. As delivering portion 16 is rotated, spring support 17 moves backwards along the cam surface and then moves forwards by the force of spring 18, producing a click at the point where cam surface ends. The user is able to perceive the required amount of the advance of the piston from the clicking sound, therefore there is no need to visually check the amount of rotation all the time when the user rotates rotary handle 20. The number of clicks per revolution of rotary handle 20 can be set up by selecting the number of division of the cam surface of ratchet portion 28 of spring support 17 and the number of division of the cam surface of ratchet portion 25 of delivering portion 16. Also, the ejected amount of liquid for each desired click which can be arbitrarily selected, can be set up by changing the thread pitch of threaded shaft 14.

Next, an applicator in accordance with the second embodiment will be described. In this embodiment, the same components as those in the first embodiment are allotted with like reference numerals, and the description for them will be omitted.

Figure 9:
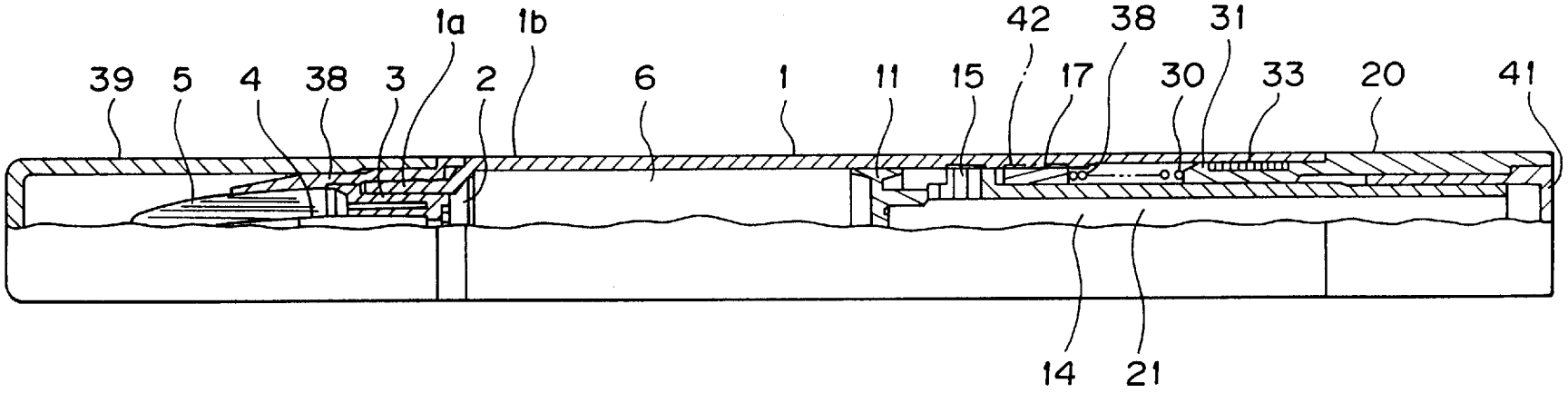
FIG. 9 is an overall half sectional view showing an applicator of the second embodiment.
Figure 10A:
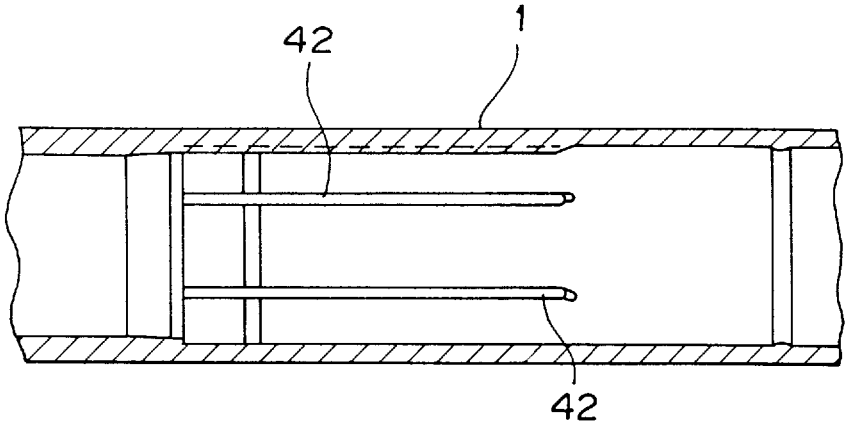
FIG. 10A is an illustrative view showing the interior of the barrel cylinder of an applicator of the second embodiment.
Figure 10B:
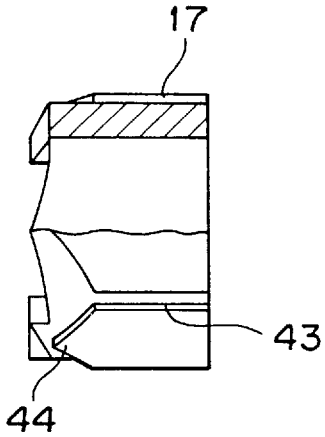
FIG. 10B is an illustrative view showing a spring support of an applicator of the second embodiment.
Figure 10C:
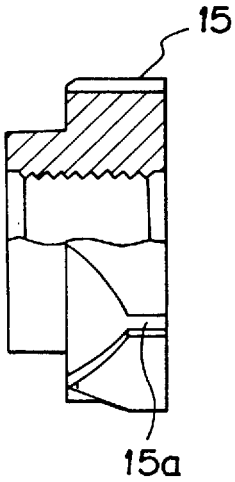
FIG. 10C is an illustrative view showing a threaded socket of an applicator of the second embodiment.
Figure 11:
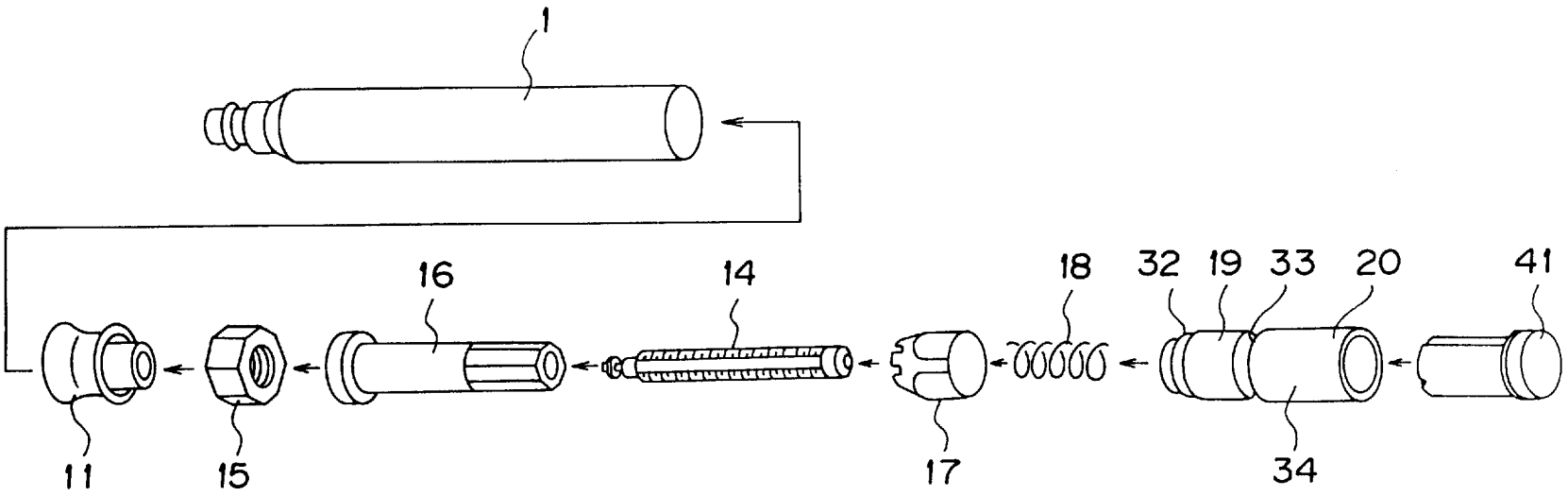
FIG. 11 is an exploded view for assembly showing a pushing device of an applicator of the second embodiment.

FIG. 9 is an overall half sectional view showing an applicator of the second embodiment; FIG. 10A shows the interior of the barrel cylinder of the applicator; FIG. 10B is an illustrative view showing a spring support; FIG. 10C is an illustrative view showing a threaded socket; and FIG. 11 is an exploded view for assembly showing a pushing device.

In the applicator in accordance with the second embodiment, a crown 41 is squeezed into the interior of the rear end of rotary handle 20 and fixed therein. The bore of crown 41 is defined by polygonal walls, forming an internally polygonal-walled portion. Delivering portion 16 has the same polygonal shape at the rear end thereof so that it is constrained in a rotational direction relative to crown 41, or rotary handle 20 but freely slides in the forward direction thereof.

The arrangement of rotary handle 20, anti-fall stopper 19 and barrel cylinder 1 is the same as in the first embodiment.

Referring to FIGS. 10A and 10B, ribs 42 are formed inside barrel cylinder 1 as shown in FIG. 10A while the outside surface of spring support 17 has grooves 43 as shown in FIG. 10B. Spring support 17 is constrained in a rotational direction relative to barrel cylinder 1 and can slide in the forward and backward directions. Provided on the outside surface of spring support 17 is a projected portion 44 which has an angled tip so as to allow ribs 42 inside barrel cylinder 1 to smoothly enter grooves 43 of spring support 17.

As shown in FIG. 10C, threaded socket 15 is constrained relative to barrel cylinder 1 in a rotational direction by the engagement between interior rib 42 of barrel cylinder 1 and outside groove 15*a* of threaded socket 15, and is fixed by the annular projection on the interior surface of barrel cylinder 1 so as not to be pulled out in the backward direction. Piston 11 has the same structure as in the first embodiment.

Mouthpiece 38 is press-fitted to barrel cylinder 1, and joint 3 is squeezed into the interior portion of opening 2 at the front end of barrel cylinder 1.

The brush as application portion 5 is attached in the same manner as in the first embodiment. That is, the brim at the rear-end portion 5*a* of the brush is caught by the stepped portion in the bore of mouthpiece 38 so as not to be pulled out in the forward direction. Joint 3 is provided on the rear side of brim of the brush so that the brush is fixed without backlashing forwards and backwards.

Pipe 4 is squeezed into the bore of joint 3 and has an inside diameter between 0.2 mm and 1.7 mm. In this embodiment, a stainless steel pipe is used in order to make the outside diameter of pipe 4 small, however, it is also possible to use a resin-formed pipe if an adequate dimensional margin determined by the size of the brush used is allowed for a thick pipe 4. It is also possible to integrally form pipe 4 with the joint.

When the length of pipe 4 is set short as in this embodiment, it can be allowed as long as the liquid of itself can flow from the brush. Moreover, in the case where the pipe is shortened, the fibers of the brush are uniformly distributed at opening portion 38*a* of mouthpiece 38 so that the brush tip will not split during the application of liquid because of the lack of the space inside the brush created by pipe 4.

Figure 12A:
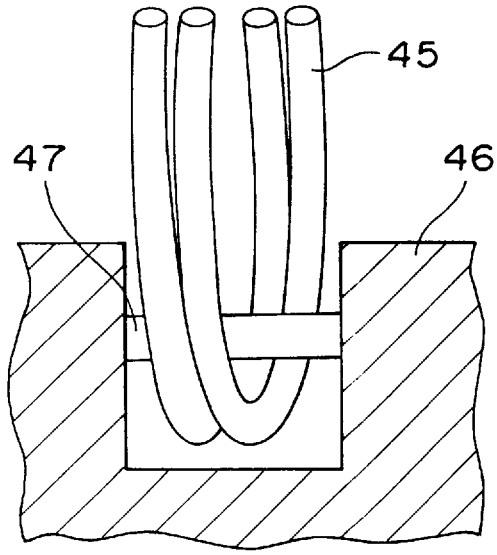
FIG. 12A is a sectional view illustrating the essential parts of an example of an application portion.
Figure 12B:
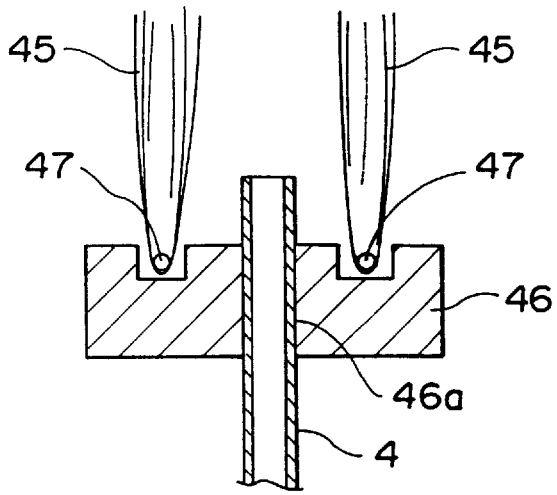
FIG. 12B is an overall sectional view of FIG. 12A.

In place of forming a brush for application portion 5 by gathering fibers 45 and fusing the rear end of the fibers, a brush can be formed by fixing fibers 45 to a base 46 by wedging means 47, as shown in FIG. 12. In this case, pipe 4 is inserted into hole 46*a* which is formed in base 46 and the front end of pipe 4 is set in an appropriate position so that the liquid conductive to the fibers of the brush will be ejected spontaneously to the tip of the brush. In this configuration, it is possible to obtain the same effect.

In the second embodiment, barrel cylinder 1 and mouthpiece 38 are fixed by squeezing. This configuration is simpler than that of using screw fitting because the assembly can be performed by only thrusting the front barrel (mouthpiece).

Next, an applicator of the third embodiment will be described. In this embodiment, the same components as those in the first and second embodiments are allotted with like reference numerals, and the description for them will be omitted.

Figure 13:
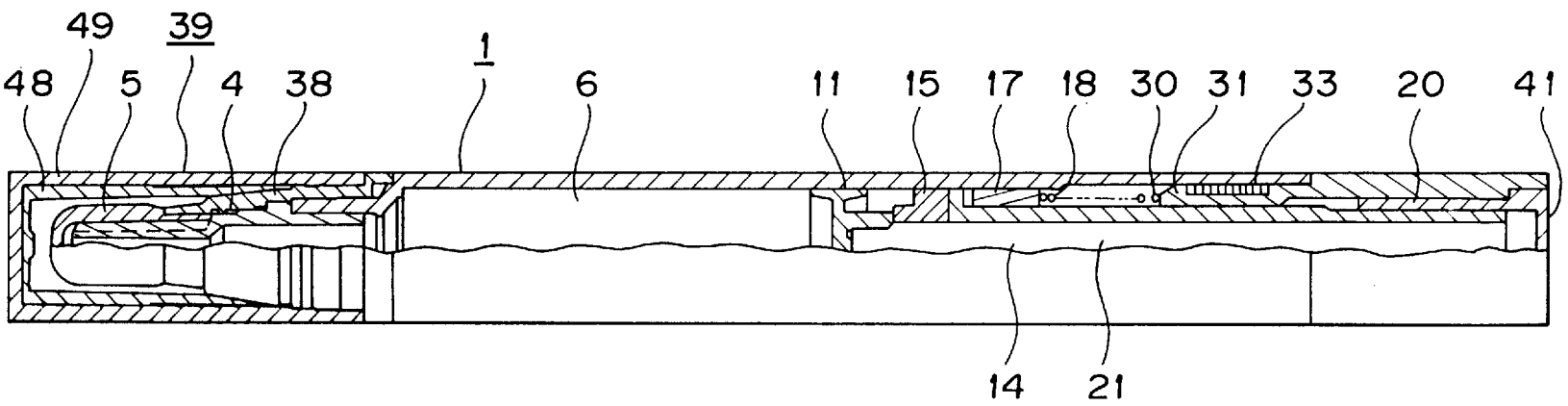
FIG. 13 is an overall half sectional view showing an applicator of the third embodiment.
Figure 14:
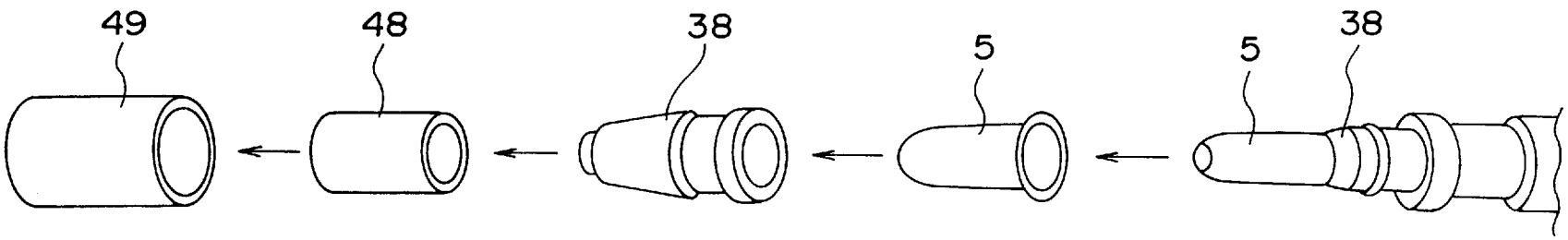
FIG. 14 is an exploded view for assembly showing the tip of an applicator of the third embodiment.
Figure 15:
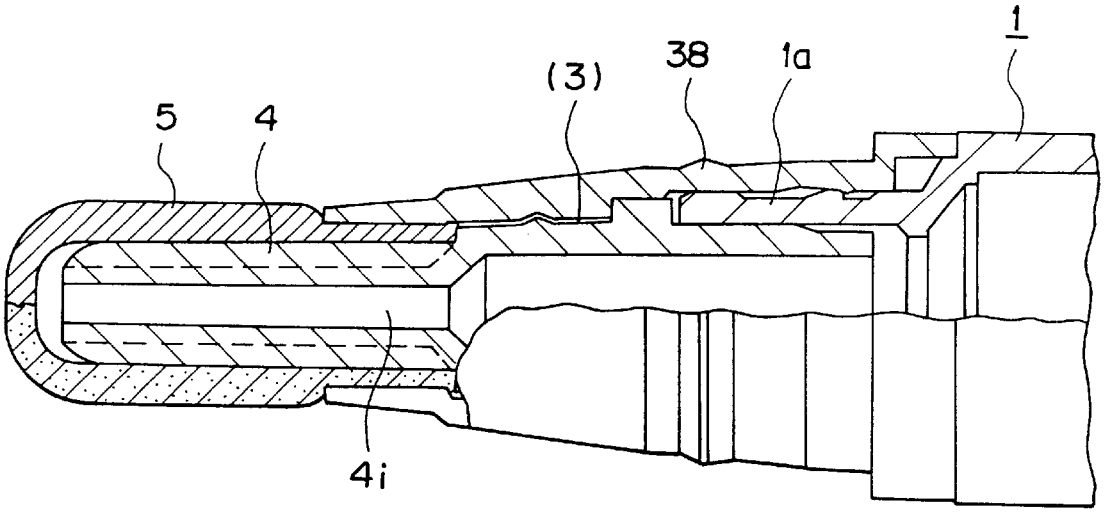
FIG. 15 is an illustrative view showing the application portion of an applicator of the third embodiment.
Figure 16:
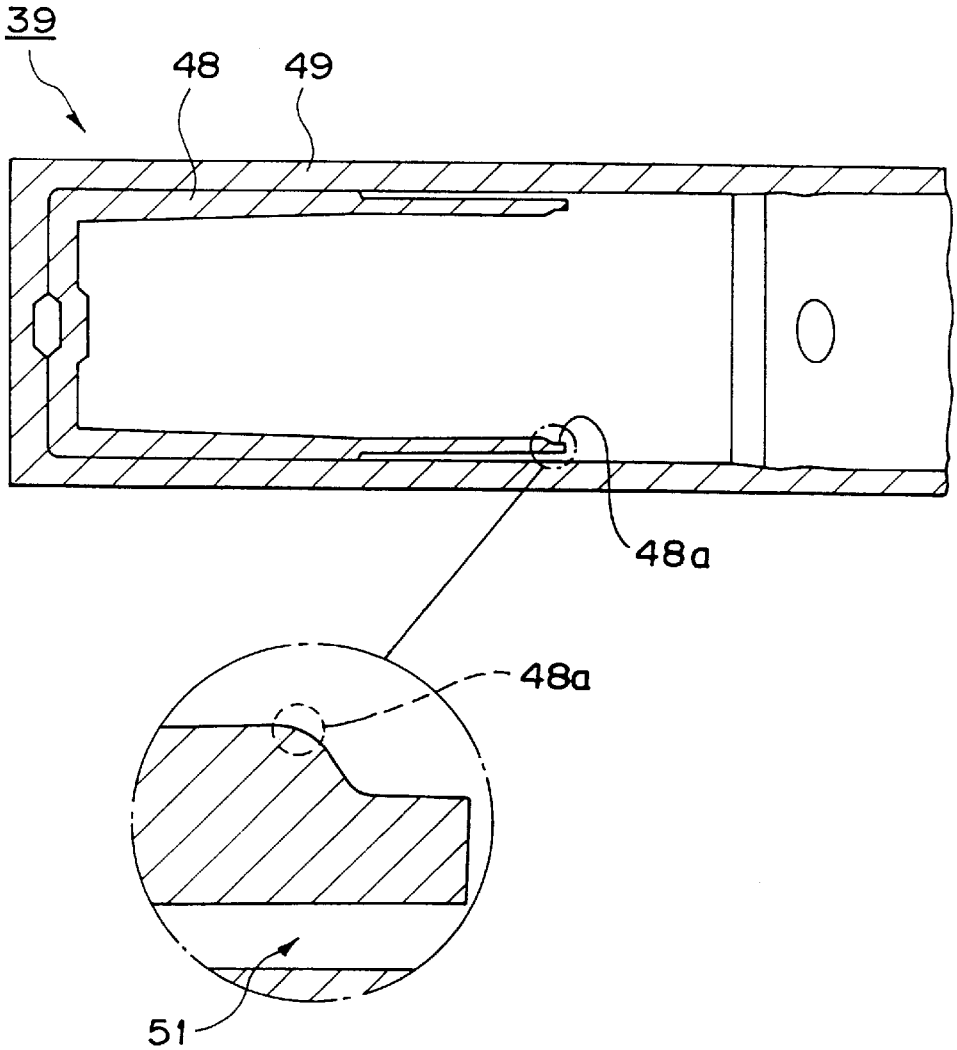
FIG. 16 is an illustrative view showing an example of a cap with an elastic part.

FIG. 13 is an overall half sectional view showing an applicator of the third embodiment; FIG. 14 is an exploded view for the assembly of a front end portion; and FIG. 15 is an illustrative view showing an application portion.

The rear part behind piston 11 is the same as in the second embodiment so that the description is omitted.

Application portion 5 is formed of a sponge-like porous foam, in place of a brush which tends to split during application. Therefore, even if pipe 4 projects out from the front end of mouthpiece 38, the pipe 4 will not come in direct contact with the skin, etc. to be applied with liquid. However, since pipe 4 will come in contact with the skin, etc. to be applied with liquid, via the soft sponge-like application material, pipe 4 is preferable to be free from edges. More preferably, the pipe itself is composed of a flexible and elastic material such as resin (LDPE, EVA, elastomer) or the like. As an application portion, it is possible to use the improved application portion as described above. In such an application portion thus configured, since the liquid permeates the porous application material and oozes out to the surface thereof, it is possible to create areas for applying liquid and areas for just spreading the liquid, separately by changing the density of the porous application material and the permeability for the liquid at different areas. This configuration is especially effective for the applicators of makeup cosmetics.

It is also possible to choose a preferable shape pipe for convenience, in place of a pipe of just straight shape. This feature is effective especially when pipe 4 is integrally formed with joint 3 and adapted to have a flat structure so that the area for liquid ejection and the area for liquid spreading are used separately, as shown in FIG. 15.

Cap 39 may be composed of an outer cap 49 for fitting and fixing mouthpiece 38 and an inner cap 48 molded of PE for more complete sealing. In this case, inner cap 48 is fitted into the bore of outer cap 49 by squeeze-fitting. The mouthpiece is formed of HDPE whose gripping force is unlikely to reduce, in place of LDPE, which is liable to creep with elapsing of time and whose gripping force is likely to reduce, whereby the pull-out strength from the mouthpiece becomes lowered. When inner cap 48 is made from PP or a resin having a greater surface strength than PP, mouthpiece 38 becomes depressed by the sealing portion of inner cap 48 upon the removal and attachment of cap 39 or when cap 39 is rotated relative to mouthpiece 38. When cap 39 is repeatedly put on and taken off, there is a risk that sealing defects occur. In contrast, when HDPE is used for inner cap 48, the inner cap is softer than the material of the mouthpiece and has good smoothness so that there is no risk that the mouthpiece becomes damaged.

When inner cap 48 is made from PP in order to prevent permeation of the solvent therethrough, it is possible to avoid scarring the mouthpiece by providing a gap 51 on the backside at the rear end of sealing portion 48*a* (the gap between the backside and the inner surface of outer cap 49) so as to impart structural resiliency.

Figure 17:
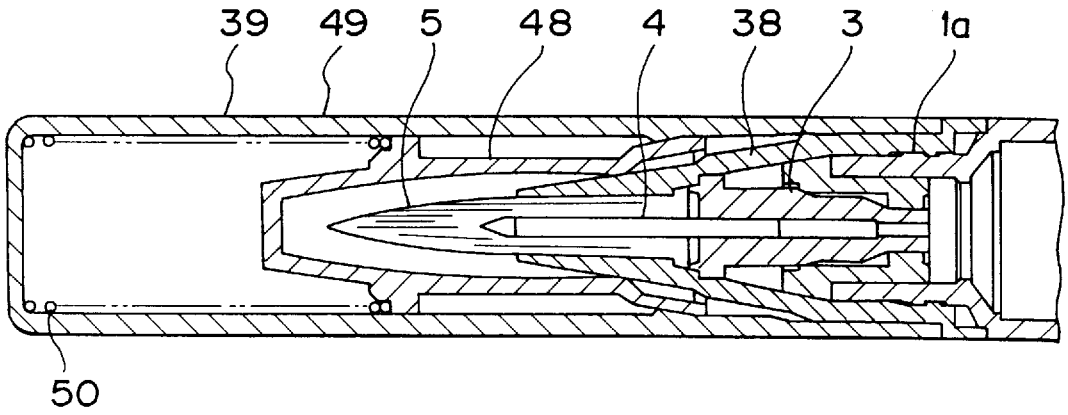
FIG. 17 is an illustrative view showing a variation of a cap.

The applicator of the invention will not be limited to the above embodiments and many modification and variation can be made. For example, as shown in FIG. 17, in the applicator of the second embodiment in which the application portion is small in diameter and cap 39 has inner cap 48 and outer cap 49, inner cap 48 is idly held in an anti-falling manner relative to outer cap 39 and inner cap 48 is urged outwards by a coil spring 50. When cap 39 is attached, inner cap 48 is adapted to abut mouthpiece 38 with a certain urging pressure.

In accordance with the invention, it is possible to definitely prevent the liquid from oozing out to the application portion before the use of the applicator. Also it is possible to provide an applicator in which the piston is not permeable by the solvent and is able to smoothly advance inside the barrel cylinder under gentle force.

What is claimed is:

1. An applicator comprising:

a barrel cylinder;

an application portion in front of said barrel cylinder;

a tank disposed behind said application portion for storing liquid inside said barrel cylinder;

a conduit for conducting the liquid ejected from said tank to said application portion;

a piston which is fitted in said tank as to slide in the axial direction; and a liquid pushing means disposed in the rear part of said barrel cylinder for pushing the liquid from said tank to said application portion via said conduit by moving said piston forwards, wherein the bore of said conduit for conducting the liquid to said application portion is set between 0.2 mm and 1.7 mm, and the viscosity of the liquid measured by the E-type viscometer within a temperature range for operation is set between 20 mPa.sec and 100,000 mPa.sec.

2. An applicator comprising:

a barrel cylinder;

an application portion in front of said barrel cylinder;

a tank disposed behind said application portion for storing liquid inside said barrel cylinder;

a conduit for conducting the liquid ejected from said tank to said application portion;

a piston which is fitted in said tank as to slide in the axial direction; and a liquid pushing means disposed in the rear part of said barrel cylinder for pushing the liquid from said tank to said application portion via said conduit by moving said piston forwards, wherein said barrel cylinder is made from PP (polypropylene) and said piston is made from HDPE (high density polyethylene) or LLDPE (linear low density polyethylene).

3. An applicator according to claim 1, wherein said liquid pushing means comprises:

a threaded shaft integrally adjoined to the rear part of said piston and having a flat portion formed on the side thereof;

a threaded block which is mated with said threaded shaft and secured to said barrel cylinder so as neither to rotate nor move in the axial direction;

a handle disposed on the rear side of said barrel cylinder;

a delivering portion which has a flange having a cam surface on the rear side thereof, has an interior hollow having a rotation transmitting bore and is linked with said handle so as to integrally rotate with said handle and freely slide in the axial direction, said rotation transmitting bore having almost the same cross-section with the cross section of said threaded shaft in a transverse plane, at a site where said flat portion is formed and having said threaded shaft inserted therein;

a spring support having a cam surface at the front end thereof; and a coil spring which presses said delivering portion and said spring support forwards to abut said delivering portion against said threaded block and fix said delivering portion in the axial direction, the rear end of said coil spring being abutted against the front end of said handle, and said threaded block, threaded shaft and/or delivering portion are formed of at least one of ABS, PBT and polycarbonate.

4. An applicator comprising:

a barrel cylinder;

an application portion in front of said barrel cylinder;

a tank disposed behind said application portion for storing liquid inside said barrel cylinder;

a conduit for conducting the liquid ejected from said tank to said application portion;

a piston which is fitted in said tank as to slide in the axial direction; and a liquid pushing means disposed in the rear part of said barrel cylinder for pushing the liquid from said tank to said application portion via said conduit by moving said piston forwards, wherein the bore of said conduit for conducting the liquid to said application portion is set between 0.2 mm and 1.7 mm, and the viscosity of the liquid measured by the E-type viscometer within a temperature range for operation is set between 20 mPa.sec and 100,000 mpa.sec, said barrel cylinder is made from PP (polypropylene) and said piston is made from HDPE (high density polyethylene) or LLDPE (linear low density polyethylene), said liquid pushing means comprises:

a threaded shaft integrally adjoined to the rear part of said piston and having a flat portion formed on the side thereof;

a threaded block which is mated with said threaded shaft and secured to said barrel cylinder so as neither to rotate nor move in the axial direction;

a handle disposed on the rear side of said barrel cylinder;

a delivering portion which has a flange having a cam surface on the rear side thereof, has an interior hollow having a rotation transmitting bore and is linked with said handle so as to integrally rotate with said handle and freely slide in the axial direction, said rotation transmitting bore having almost the same cross-section with the cross section of said threaded shaft in a transverse plane, at a site where said flat portion is formed and having said threaded shaft inserted therein;

a spring support having a cam surface at the front end thereof; and a coil spring which presses said delivering portion and said spring support forwards to abut said delivering portion against said threaded block and fix said delivering portion in the axial direction, the rear end of said coil spring being abutted against the front end of said handle, and said threaded block, threaded shaft and/or delivering portion are formed of at least one of ABS, PBT and polycarbonate.

5. An applicator according to claim 2, wherein said liquid pushing means comprises:

a threaded shaft integrally adjoined to the rear part of said piston and having a flat portion formed on the side thereof;

a threaded block which is mated with said threaded shaft and secured to said barrel cylinder so as neither to rotate nor move in the axial direction;

a handle disposed on the rear side of said barrel cylinder;

a delivering portion which has a flange having a cam surface on the rear side thereof, has an interior hollow having a rotation transmitting bore and is linked with said handle so as to integrally rotate with said handle and freely slide in the axial direction, said rotation transmitting bore having almost the same cross-section with the cross section of said threaded shaft in a transverse plane, at a site where said flat portion is formed and having said threaded shaft inserted therein;

a spring support having a cam surface at the front end thereof; and a coil spring which presses said delivering portion and said spring support forwards to abut said delivering portion against said threaded block and fix said delivering portion in the axial direction, the rear end of said coil spring being abutted against the front end of said handle, and said threaded block, threaded shaft and/or delivering portion are formed of at least one of ABS, PBT and polycarbonate.

* * * * *